US009820525B2

(12) United States Patent
Weber et al.

(10) Patent No.: US 9,820,525 B2
(45) Date of Patent: Nov. 21, 2017

(54) HELMET OMNIDIRECTIONAL ENERGY MANAGEMENT SYSTEMS

(71) Applicant: 6D Helmets, LLC, Brea, CA (US)

(72) Inventors: Robert Weber, Fullerton, CA (US); Robert Daniel Reisinger, Stevenson Ranch, CA (US)

(73) Assignee: 6D Helmets, LLC, Brea, CA (US)

( * ) Notice: Subject to any disclaimer, the term of this patent is extended or adjusted under 35 U.S.C. 154(b) by 256 days.

(21) Appl. No.: 14/607,004

(22) Filed: Jan. 27, 2015

(65) Prior Publication Data

US 2015/0157082 A1 Jun. 11, 2015

Related U.S. Application Data

(63) Continuation of application No. 13/368,866, filed on Feb. 8, 2012, now Pat. No. 8,955,169.

(60) Provisional application No. 61/462,914, filed on Feb. 9, 2011, provisional application No. 61/554,351, filed on Nov. 1, 2011.

(51) Int. Cl.

| | |
|---|---|
| ***A42B 3/00*** | (2006.01) |
| ***A42B 3/12*** | (2006.01) |
| ***A42B 3/06*** | (2006.01) |

(52) U.S. Cl.

CPC ..... *A42B 3/125* (2013.01); *A42B 3/064* (2013.01)

(58) Field of Classification Search

CPC ..... A01N 25/18; A01N 25/20; A42B 3/125; A42B 3/064

See application file for complete search history.

(56) References Cited

U.S. PATENT DOCUMENTS

| | | | | |
|---|---|---|---|---|
| 3,039,108 | A | 6/1962 | Lohrenz | |
| 3,413,656 | A | 12/1968 | Vogliano et al. | |
| 3,877,076 | A | 4/1975 | Summers et al. | |
| 4,012,794 | A | 3/1977 | Nomiyama | |
| 4,024,586 | A * | 5/1977 | Lamb | A42B 3/124 2/414 |
| 4,064,565 | A | 12/1977 | Griffiths | |
| 4,213,202 | A * | 7/1980 | Larry | A41D 13/015 2/456 |
| 4,290,149 | A | 9/1981 | Aileo | |
| 4,307,471 | A | 12/1981 | Lovell | |
| 4,345,338 | A * | 8/1982 | Frieder, Jr. | A42B 3/124 2/414 |
| 4,432,099 | A | 2/1984 | Grick et al. | |
| 4,472,472 | A | 9/1984 | Schultz | |

(Continued)

FOREIGN PATENT DOCUMENTS

| | | |
|---|---|---|
| CA | 693175 | 8/1964 |
| CN | 1316207 | 10/2001 |

(Continued)

*Primary Examiner* — Khaled Annis

(74) *Attorney, Agent, or Firm* — Haynes and Boone, LLP

(57) ABSTRACT

An embodiment of a safety helmet for protecting the human head against repetitive impacts, moderate impacts and severe impacts so as to significantly reduce the likelihood of both translational and rotational brain injury and concussions includes an outer shell, an outer liner disposed within and coupled to the outer shell, and an inner liner disposed within and coupled in spaced opposition to the outer liner by a plurality of isolation dampers for omnidirectional movement of the inner liner relative to the outer liner and the outer shell.

12 Claims, 18 Drawing Sheets

(56) References Cited

U.S. PATENT DOCUMENTS 4,555,816 A 12/1985 Broersma
4,586,200 A 5/1986 Poon
4,627,114 A 12/1986 Mitchell
4,987,609 A 1/1991 Zahn
5,068,922 A 12/1991 Zahn
5,086,520 A 2/1992 Arai
5,204,998 A 4/1993 Liu
5,309,576 A 5/1994 Broersma
5,581,819 A 12/1996 Garneau
5,619,756 A 4/1997 Garneau
5,669,079 A 9/1997 Morgan
5,815,846 A 10/1998 Calonge
5,833,796 A 11/1998 Matich
5,950,244 A 9/1999 Fournier et al.
5,956,777 A 9/1999 Popovich
5,978,972 A 11/1999 Stewart et al.
6,009,566 A 1/2000 Hubbard
6,052,835 A 4/2000 O'Shea
6,070,271 A 6/2000 Williams
6,070,905 A 6/2000 Renault
6,093,468 A 7/2000 Toms et al.
6,314,586 B1 11/2001 Duguid
6,378,140 B1 * 4/2002 Abraham ..... A42B 3/064 2/411
6,401,260 B1 * 6/2002 Porth ..... A42B 1/004 2/171
6,418,564 B1 7/2002 Sheridan
6,453,476 B1 9/2002 Moore, III
6,536,052 B2 3/2003 Tao et al.
6,560,787 B2 5/2003 Mendoza
6,658,671 B1 12/2003 Von Holst et al.
6,751,808 B2 6/2004 Puchalski
6,925,657 B2 8/2005 Takahashi et al.
6,931,669 B2 8/2005 Ashline
6,996,856 B2 2/2006 Puchalski
D521,191 S 5/2006 Berger
7,076,811 B2 7/2006 Puchalski
7,159,249 B2 1/2007 Dennis et al.
7,207,071 B2 4/2007 Pierce
7,299,505 B2 11/2007 Dennis et al.
7,328,462 B1 2/2008 Straus
7,376,981 B2 5/2008 Shida
7,574,754 B2 8/2009 Arai
7,676,854 B2 3/2010 Berger et al.
7,735,157 B2 6/2010 Ikeda
7,735,158 B2 6/2010 Tsurumi
7,748,059 B2 7/2010 Arai
7,802,320 B2 9/2010 Morgan
7,832,023 B2 11/2010 Crisco
7,895,681 B2 * 3/2011 Ferrara ..... B29C 45/0053 2/455
7,930,771 B2 4/2011 Depreitere et al.
2001/0032351 A1 * 10/2001 Nakayama ..... A42B 3/064 2/412
2002/0023291 A1 2/2002 Mendoza
2004/0117896 A1 6/2004 Madey et al.
2005/0246824 A1 * 11/2005 Berger ..... A42B 3/124 2/412
2006/0059606 A1 * 3/2006 Ferrara ..... A01N 25/18 2/412
2007/0000032 A1 * 1/2007 Morgan ..... A42B 3/128 2/412
2007/0190292 A1 * 8/2007 Ferrara ..... A42B 3/121 428/166
2007/0190293 A1 8/2007 Ferrara
2008/0155735 A1 7/2008 Ferrara
2008/0256686 A1 * 10/2008 Ferrara ..... A41D 13/0155 2/413
2009/0320185 A1 * 12/2009 Hassler ..... A42B 3/125 2/414
2010/0000009 A1 * 1/2010 Morgan ..... A42B 3/124 2/414
2010/0186150 A1 7/2010 Ferrara
2010/0205722 A1 * 8/2010 Kim ..... A41D 31/005 2/455
2010/0258988 A1 10/2010 Darnell et al.
2010/0295221 A1 11/2010 Kligerman et al.
2011/0047685 A1 * 3/2011 Ferrara ..... A42B 3/063 2/455
2012/0060251 A1 3/2012 Schimpf
2012/0139172 A1 * 6/2012 Hawkins ..... A41D 13/0518 267/136
2013/0247284 A1 9/2013 Hoshizaki et al.
2014/0013491 A1 * 1/2014 Hoshizaki ..... A42B 3/12 2/411
2015/0157082 A1 6/2015 Weber et al.

FOREIGN PATENT DOCUMENTS

CN 1997506 7/2007
CN 101827537 9/2010
EP 1142495 10/2001
EP 2428129 3/2012
WO WO2011/139224 11/2011

* cited by examiner

HELMET OMNIDIRECTIONAL ENERGY MANAGEMENT SYSTEMS

CROSS-REFERENCE TO RELATED APPLICATIONS

This patent application is a continuation of U.S. patent application Ser. No. 13/368,866, filed Feb. 8, 2012, which is incorporated herein by reference in its entirety. U.S. patent application Ser. No. 13/368,866 claims the benefit of and priority to U.S. Provisional Patent Application No. 61/462,914 filed Feb. 9, 2011 and 61/554,351 filed Nov. 1, 2011, both of which are incorporated herein by reference in their entirety.

TECHNICAL FIELD

One or more embodiments of the present invention generally relate to safety equipment, and more particularly, to protective helmets that protect the human head against repetitive impacts, moderate impacts and severe impacts so as to significantly reduce the likelihood of both translational and rotational brain injury and concussions.

BACKGROUND

Action sports (e.g., skateboarding, snowboarding, bicycle motocross (BMX), downhill mountain biking, and the like), motorsports (e.g., off-road and on-road motorcycle riding and racing) and traditional contact sports (e.g., football and hockey) continue to grow at a significant pace throughout the world as each of these sports expands into wider participant demographics. While technology and sophisticated training regimes continue to improve the performance capabilities for such athletes/participants, the risk of injury attendant to these activities also increases. To date, helmet-type head protection devices have not experienced any significant new technologies that improve protection of the athlete's head and brain in the event of an impact incident outside the advent of duel density foam liners made of greater thickness utilizing softer foams in general. Current "state of the art" helmets are not keeping pace with the evolution of sports and the capabilities of athletes. At the same time, science is providing alarming data related to the traumatic effects of both repetitive but moderate, and severe impacts to the head. While concussions are at the forefront of current concerns, rotational brain injuries from the same concussive impacts are no less of a concern, and in fact, are potentially more troublesome.

Head injuries result from two types of mechanical forces—contact and non-contact. Contact injuries arise when the head strikes or is struck by another object. Non-contact injuries are occasioned by cranial accelerations or decelerations caused by forces acting on the head other than through contact with another object, such as whiplash-induced forces. Two types of cranial acceleration are recognized, which can act separately or in combination with each other. "Translational" acceleration occurs when the brain's centre of gravity (CG), located approximately at the pineal gland, moves in a generally straight line. "Rotational" or angular acceleration occurs when the head turns about its CG without linear movement of the CG.

Translational accelerations/decelerations can result in so-called "coup" and "contrecoup" head injuries that respectively occur directly under the site of impact with an object and on the side of the head opposite the area that was impacted. By contrast, studies of the biomechanics of brain injury have established that forces applied to the head which result in a rotation of the brain about its CG cause diffuse brain injuries. It is this type of movement that is responsible for subdural hematomas and diffuse axonal injury (DAI), one of the most devastating types of traumatic brain injury.

Referring to FIG. 1, the risk of rotational brain injury is greatest when an impact force 10 is applied to the head or helmet 12 of a wearer from at an oblique angle, i.e., greater or less than 90 degrees to a perpendicular plane 14 drawn through the CG 16 of the brain. Such impacts cause rotational acceleration 18 of the brain around CG, potentially shearing brain tissue and causing DAI. However, given the distribution of brain matter, even direct linear or translational impacts can generate shear forces within the brain sufficient to cause rotational brain injuries. Angular acceleration forces can become greater, depending on the severity (i.e., force) of the impact, the degree of separation of the impact force 10 from 90 degrees to the perpendicular plane 14, and the type of protective device, if any, that the affected individual is wearing. Rotational brain injuries can be serious, long lasting, and potentially life threatening.

Safety helmets generally use relatively hard exterior shells and relatively soft, flexible, compressible interior padding, e.g., fit padding, foam padding, air filled bladders, or other structures, to manage impact forces. When the force applied to the helmet exceeds the capability of the combined resources of the helmet to reduce impacts, energy is transferred to the head and brain of the user. This can result in moderate concussion or severe brain injury, including a rotational brain injury, depending on the magnitude of the impact energy.

Safety helmets are designed to absorb and dissipate as much energy as possible over the greatest amount of time possible. Whether the impact causes direct linear or translational acceleration/deceleration forces or angular acceleration/deceleration forces, the helmet should eliminate or substantially reduce the amount of energy transmitted to the user's head and brain.

SUMMARY

In accordance with one or more embodiments of the present disclosure, omnidirectional impact energy management systems are provided for protective helmets that can significantly reduce both rotational and linear forces generated from impacts to the helmets over a broad spectrum of energy levels.

The novel techniques, for one or more embodiments, enable the production of hard-shelled safety helmets that can provide a controlled internal omnidirectional relative displacement capability, including relative rotation and translation, between the internal components thereof. The systems enhance modem helmet designs for the improved safety and well being of athletes and recreational participants in sporting activities in the event of any type of impact to the wearer's head. These designs specifically address, among other things, the management, control, and reduction of angular acceleration forces, while simultaneously reducing linear impact forces acting on the wearer's head during such impacts.

In accordance with an embodiment, a safety helmet comprises an outer shell, an outer liner disposed within and coupled to the outer shell, and an inner liner disposed within and coupled in spaced opposition to the outer liner by a plurality of isolation dampers for omnidirectional movement relative to the outer liner and shell.

In accordance with an embodiment, a method for making a helmet comprises affixing an outer liner to and inside of an outer shell and coupling an inner liner in spaced opposition to and inside of the outer liner for omnidirectional movement of the inner liner relative to the outer liner and the outer shell.

The scope of this invention is defined by the claims, which are incorporated into this section by reference. A more complete understanding of embodiments of the present invention will be afforded to those skilled in the art, as well as a realization of additional advantages thereof, by a consideration of the following detailed description of one or more embodiments. Reference will be made to the appended sheets of drawings that will first be described briefly, and within which like reference numerals are used to identify like elements illustrated in one or more of the figures thereof.

DETAILED DESCRIPTION

Figure 1:
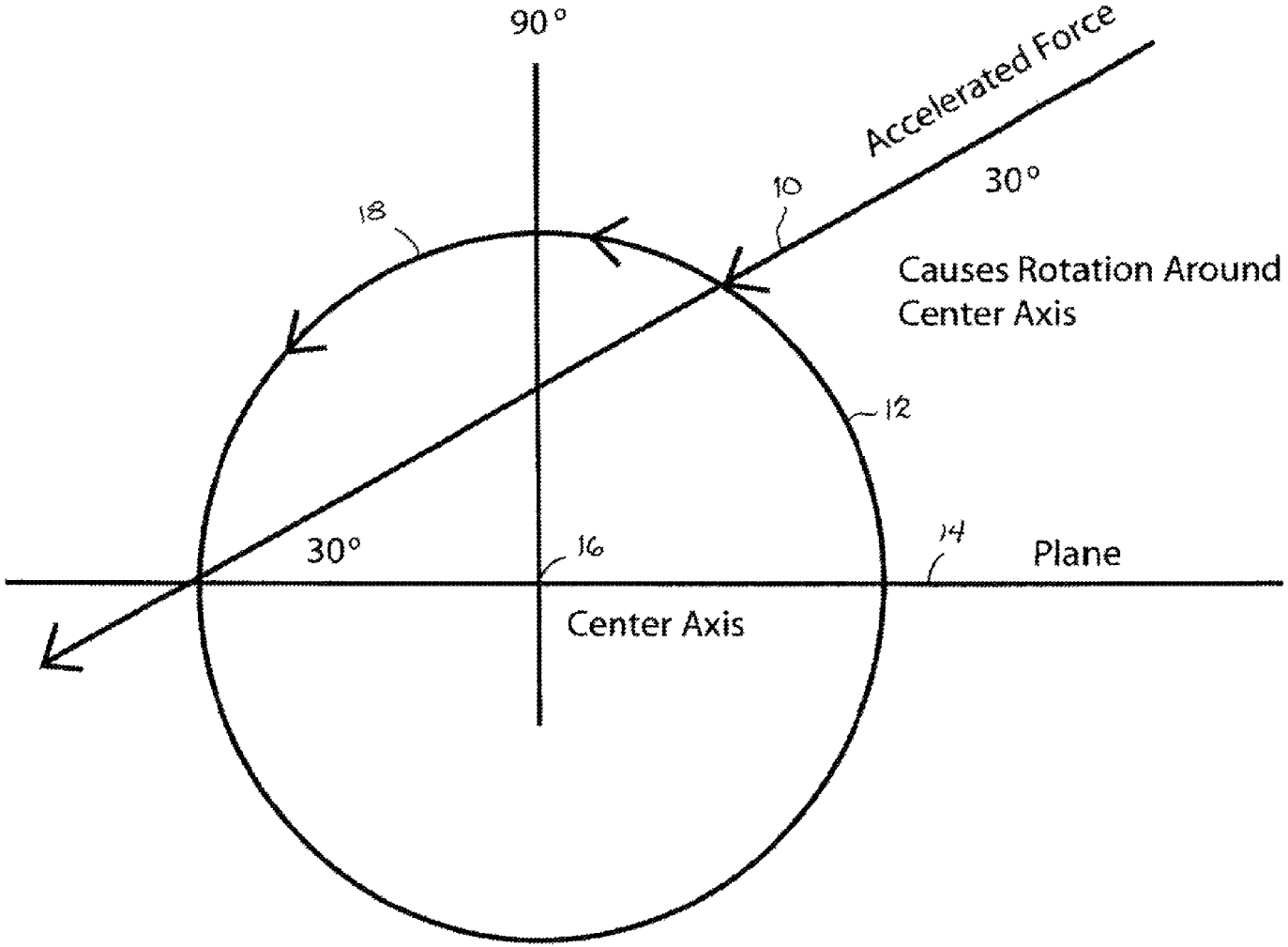
FIG. 1 is a diagram of an impact force acting on the head or helmet of a wearer so as to cause rotational acceleration of the wearer's brain around the brain's center of gravity.

In accordance with one or more embodiments of this disclosure, omnidirectional impact energy management systems for helmets are provided that can significantly reduce both rotational and linear forces generated from impacts imparted to the helmets. The systems enable a controlled internal omnidirectional relative displacement capability, including relative rotational and translational movement, between the internal components of a hard shelled safety helmet.

One or more embodiments disclosed herein are particularly well suited to helmets that can provide improved protection from both potentially catastrophic impacts and repetitive impacts of varying force that, while not causing acute brain injury, can cause cumulative harm. The problem of cumulative brain injury, i.e., Second Impact Syndrome (SIS), is increasingly recognized as a serious problem in certain sports, such as American football, where much of the force of non-catastrophic contact is transferred to the head of the wearer. In various example embodiments, isolation dampers are configured with specific flex and compression characteristics to manage a wide range of repetitive and severe impacts from all directions, thus addressing the multitude of different risks associated with diverse sports, such as football, baseball, bicycle riding, motorcycle riding, skateboarding, rock climbing, hockey, snowboarding, snow skiing, auto racing, and the like.

In accordance with one or more example embodiments hereof, safety helmets can comprise at least two layers. One of these layers, an inner liner, is disposed in contact with the wearer's head, either directly or via a fitment or so-called "comfort liner." Another layer can comprise an outer liner affixed to a relatively hard outer shell of the helmet. In some embodiments, one or more intermediate liners can be disposed between the inner and outer liners. These layers can be formed of any suitable material, including energy absorbing materials of the types commonly used in the industry, such as expanded polystyrene (EPS) or expanded polypropylene (EPP).

In an example embodiment, an outer surface of an inner liner is coupled to an inner surface of an outer liner, which can have an outer surface affixed to an inner surface of the hard outer shell of the helmet, with shock absorbing and dampening components that enable controlled, omnidirectional relative rotational and translational displacements to take place between the inner and outer liners. Thus, the two liners are coupled with each other in such a way that they can displace relative to each other omnidirectionally in response to both angular and translational forces from a glancing or direct blow to the hard outer shell of the helmet. The engagement between the inner and outer liners enables a controlled, omnidirectional relative movement between the two liners to reduce the transfer of forces and resulting accelerations originating from the hard outer shell of the helmet to the head and brain of a wearer.

The relative movement of the inner and outer layers or liners can be controlled via various suspension, dampening, and motion controlling components that are disposed between the liners and couple them together for relative movement. In some embodiments, additional liners or partial liners can be inserted between the inner and outer liners. Thus, the energy absorbing structure can comprise various liner components, with or without air gaps between them, that enable such controlled omnidirectional relative displacement between one or more of the liners. The liners and other layers can comprise multi- or single-density EPS, EPP, or any other suitable materials, such as expanded polyurethane (EPU). Proper restraint on the wearer's head can be managed by, for example, a chin-strap and/or a neck security device of a type commonly used on conventional helmets.

Figure 2:
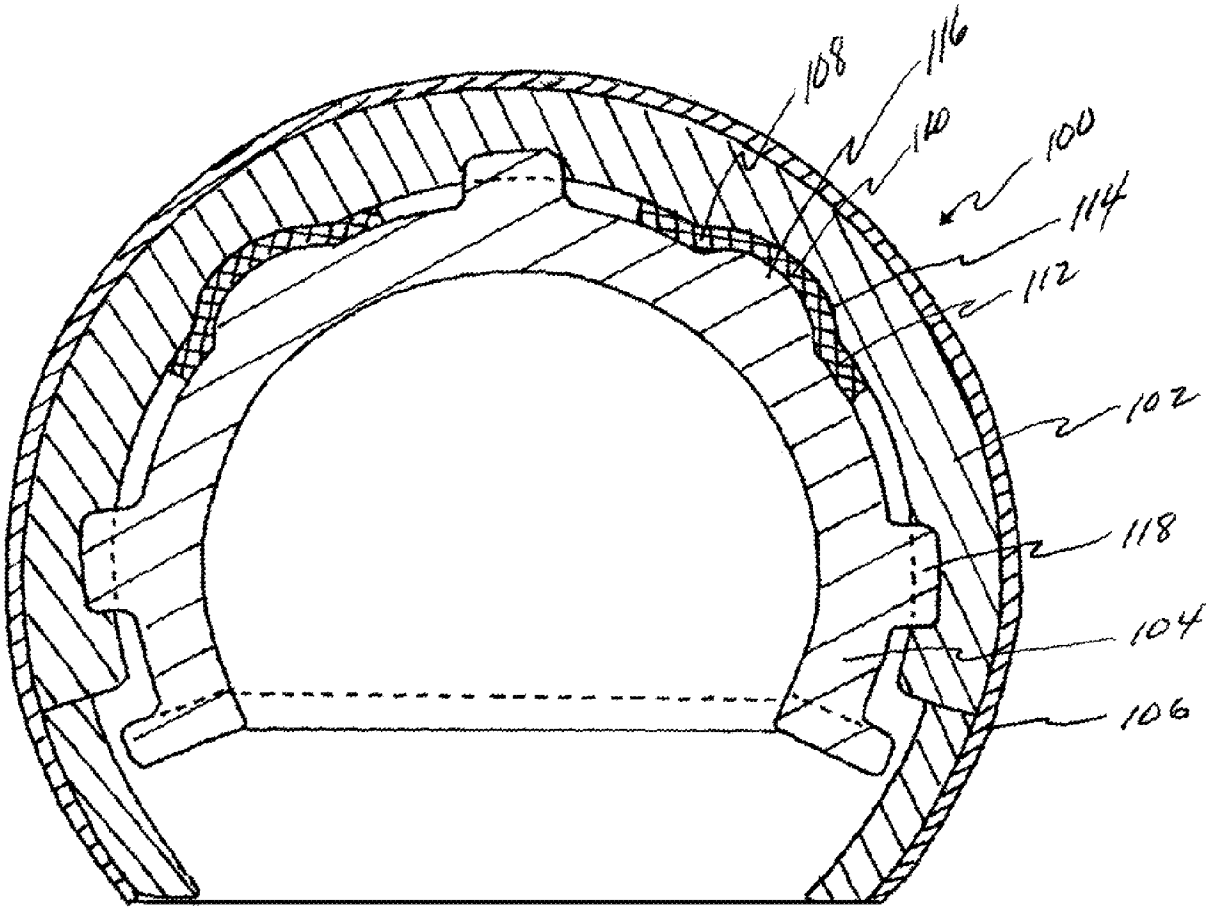
FIG. 2 is a cross-sectional view of an example of a helmet, taken at the coronal plane thereof, in accordance with an embodiment.

FIG. 2 is a partial cross-sectional view taken at the coronal plane of an example embodiment of a helmet 100, which includes a hollow, semispheroidal outer liner 102 disposed circumferentially around a similarly shaped inner liner 104 and inside of a correspondingly shaped, relatively hard helmet outer shell 106. In the particular example embodiment illustrated, the outer liner 102 is attached directly to the inside surface of the helmet shell 106, as is typical in conventional helmet design. The relatively hard outer shell 106 can be manufactured from conventional materials, such as fiber-resin lay-up type materials, polycarbonate plastics, polyurethane, or any other appropriate materials, depending on the specific application intended for the helmet 100.

The inner and outer liners 104 and 102 are coupled to each other so as to form an internal subassembly by the use of a plurality of resilient, e.g., elastomeric, structures referred to herein as "isolation dampers." As illustrated in FIG. 2, the isolation dampers 108 can comprise a generally circular disk having a concave, e.g., generally spherical, recess 110 disposed in a lower surface thereof, a correspondingly shaped convex protrusion extending from an upper surface thereof, and a flange 112 extending around the circumfery thereof. The inner liner 104 can include a plurality of convex, e.g., generally spherical, protrusions 116, each disposed in spaced opposition to a corresponding one of a plurality of correspondingly shaped concave recesses 114 disposed in the outer liner 102.

In an embodiment, one or both of the concave and convex features of the isolation dampers 108 can be complementary in shape to one or both of those of the concave and convex features of the inner and outer liners 104 and 102, respectively. The isolation dampers 108 are disposed between the inner and outer liners 104 and 102 such that their concave recesses 110 are respectively disposed over a corresponding one of the convex protrusions 116 on the inner liner 104, and the convex protrusions on the isolation dampers 108 are respectively disposed within corresponding ones of the concave recesses 114 in the outer liner 102.

Figure 3:
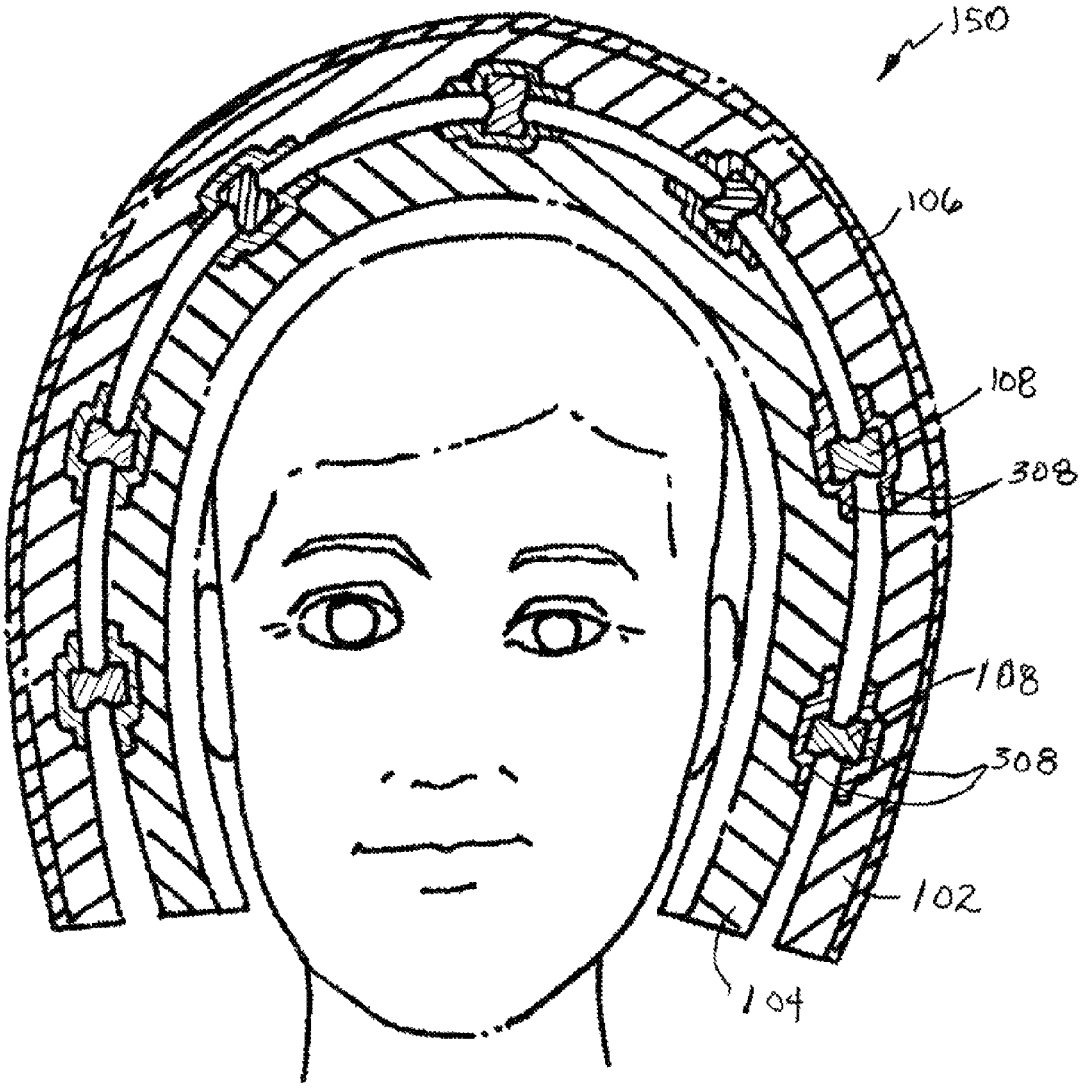
FIG. 3 is a cross-sectional view of another example helmet, taken at the coronal plane, showing a wearer's head disposed therein, in accordance with an embodiment.

FIG. 3 is a cross-sectional view of another example embodiment of helmet 150 similar to that of FIG. 2, showing a wearer's head disposed therein. The helmet 150 of FIG. 2, includes an outer liner 102 disposed circumferentially around an inner liner 104, and both liners 104, 102 are disposed inside of a correspondingly shaped, relatively hard helmet shell 106. As in the helmet 100 of FIG. 2, the outer liner 102 is affixed directly to the inside surface of the outer shell 106, and the inner liner 104 is coupled to the outer liner 104 by a plurality of isolation dampers 108 for omnidirectional movement relative thereto. However, as illustrated in FIG. 3, in some embodiments, the isolation dampers 108 can comprise elongated cylindrical members having opposite ends respectively retained within isolation damper retainer cups, or inserts 308, respectively attached to corresponding ones of the inner and outer liners 104 and 102. As discussed in more detail below, the inserts 308 can comprise a variety of different materials and configurations and can be attached to the corresponding liners 102, 104 by a variety of attachment techniques.

As illustrated in FIGS. 2 and 3, plurality of the isolation dampers 108 can be provided at selected points around the circumfery of the helmets 100 or 150. Different isolation dampers 108 can be designed for specific applications and effectively "tuned" to manage the anticipated rotational and translational forces applied thereto. The isolation dampers 108 can be variously configured to control the amount of rotational force that will cause displacement of the various liners of the helmet 100 and, as discussed in more detail below, can be configured such that they will tend to cause the inner liner 104 to return to its original position relative to the outer liner 102 after the force of an impact is removed from the helmet 100 or 150. It will be readily apparent to those skilled in the art that isolation dampers 108 can be configured in a wide range of configurations and materials varying from those shown and described in the example embodiments, and the general principles described herein can be applied without departing from the spirit and scope of the invention.

In some embodiments, limits or "stops" can be designed into and between the liners to prevent over-rotation or over-displacement between the layers during an impact incident. Referring again to FIG. 2, in one embodiment, the inner liner 104 can be provided with multiple flanges 118 extending outward from the inner liner 104 to act as rotational stops by impacting with an edge of a corresponding recess in the outer liner 102 at maximum displacement. Other embodiments can use features of the helmet's exterior shell 106, a "comfort" liner (not illustrated), or perimeter moldings (not illustrated) to act as stops.

Figure 4:
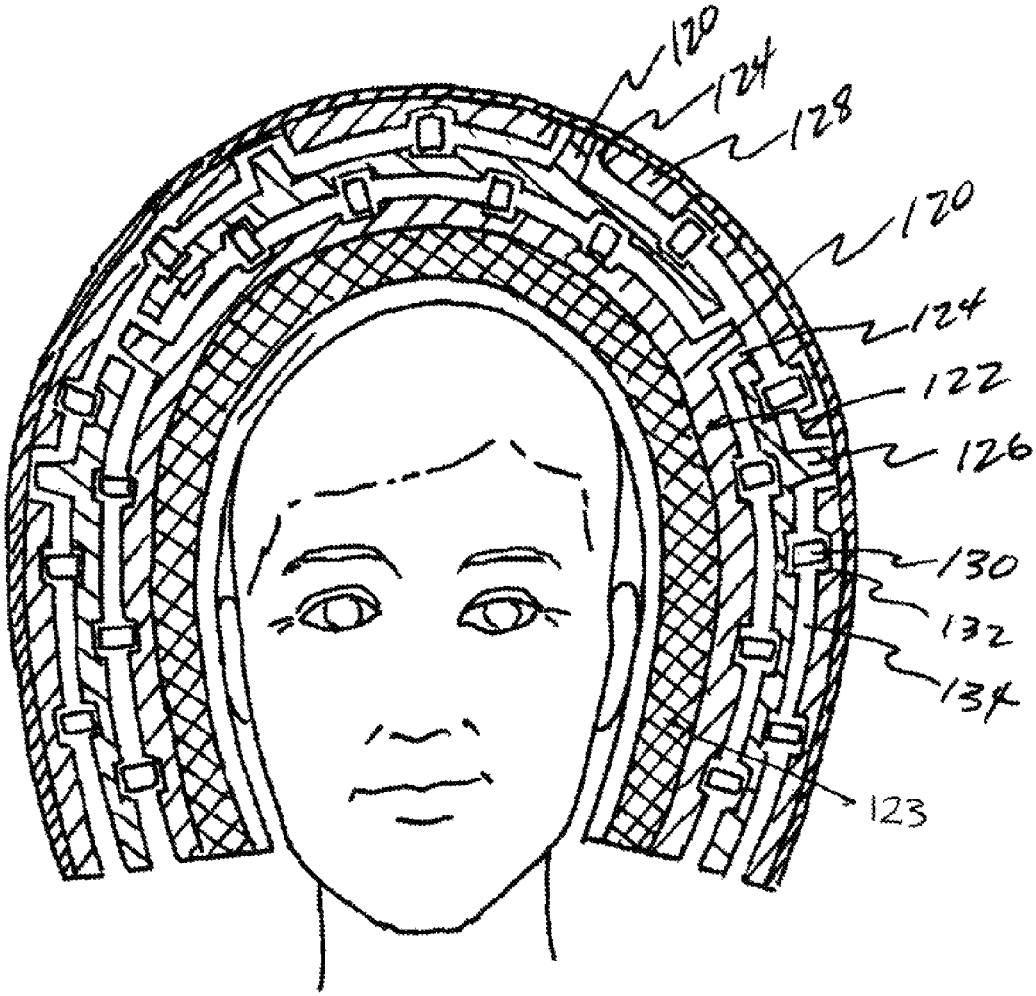
FIG. 4 is a cross-sectional view of another example helmet, taken at the coronal plane, showing a wearer's head disposed therein, in accordance with an embodiment.

In other embodiments, one or more additional layers or liners can be inserted between an inner liner and outer liner. Such "intermediate" liners can be formed of, for example, EPS, EPP, EPU, or any other suitable materials. For example, as illustrated in FIG. 4, in an example embodiment, a plurality of lugs 120 can extend from an outer surface of the inner liner 122 to engage in corresponding recesses 124 disposed in an intermediate liner 126, while similar lugs 120 can extend from the middle layer 126 to engage in corresponding recesses 124 in an outer liner 128. These lugs 120 and corresponding recesses 124 can be configured to allow for a controlled amount of rotational movement between the intermediate 126 and the inner and outer liners 122 and 128. Optionally, in some embodiments, isolation dampers 130 of various configurations can also be disposed between, e.g., the inner and outer liners 122 and 128 and/or the intermediate liner 126 to further dissipate the energy of impacts. Additionally, as illustrated in FIG. 4, in some embodiments, a "comfort" liner 123 configured to closely surround the head of the wearer can be attached or otherwise coupled to an inner surface of the inner liner 122.

As further illustrated in FIG. 4, in some embodiments, the isolation dampers 130 can be cylindrical in shape, and configured such that they engage within corresponding recesses 132 in the adjacent surfaces of the inner, intermediate and outer liners 122, 126 and 128 so as to create a space or air gap 134 between the respective opposing surfaces thereof. The isolation dampers 130 can be configured to flex, bend, and/or compress to absorb the energy of impacts to the helmet from all directions, and thereby enable the inner and intermediate liners 122 and 126 to move relative to each other and/or the outer liner 128.

Figure 5:
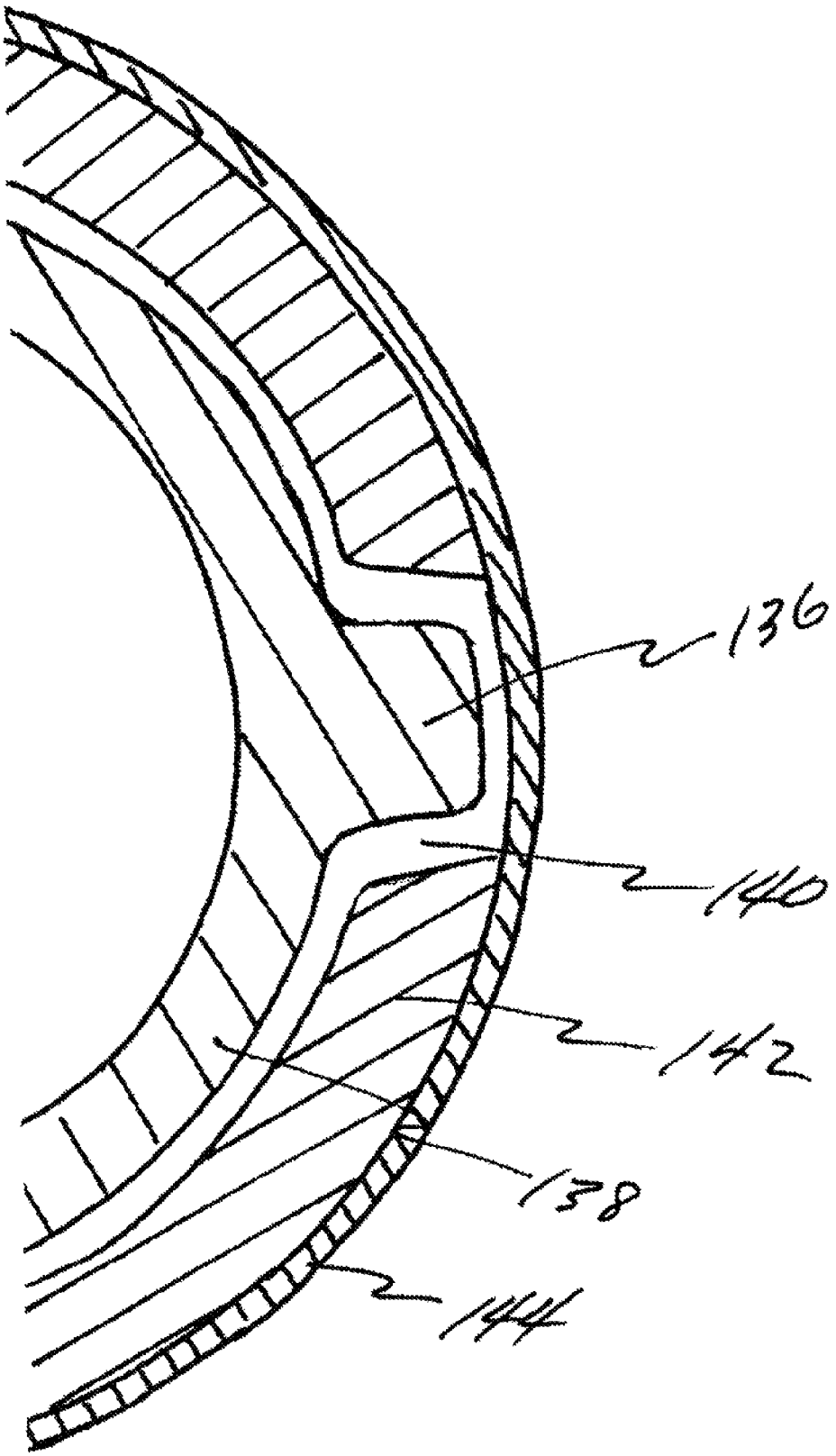
FIG. 5 is an enlarged partial cross-sectional view of another example helmet, showing a lug on an inner liner thereof engaged in a recess in an outer liner thereof, in accordance with an embodiment.
Figure 6:
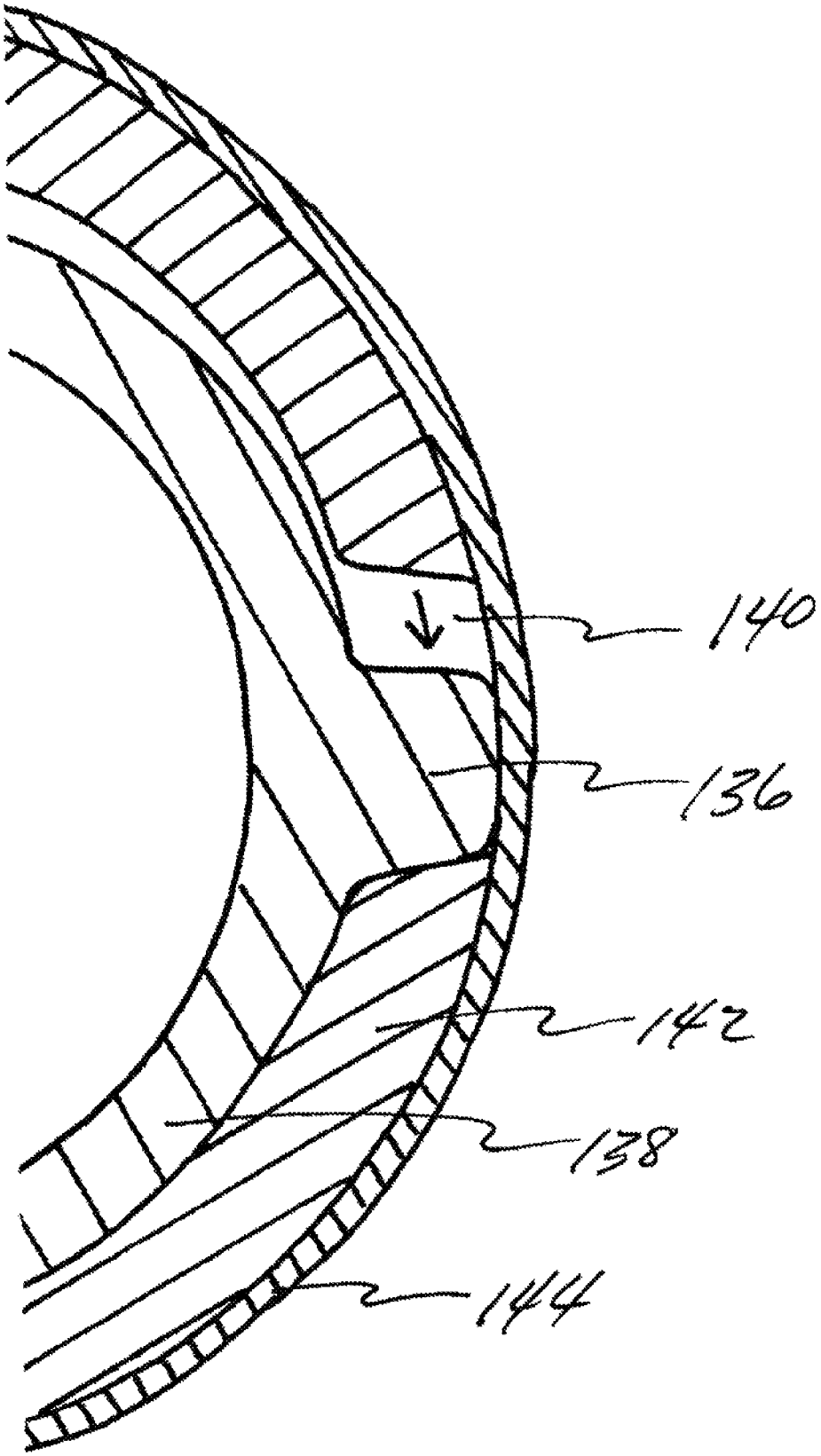
FIG. 6 is an enlarged partial cross-sectional view of the helmet of FIG. 5, showing displacement of the lug within the recess in response to a rotation of the inner liner relative to the outer liner, in accordance with an embodiment.

As illustrated in FIGS. 5 and 6, in another embodiment, one or more lugs 136 can be disposed on the outer surface of an inner liner 138 so as to respectively engage within corresponding recesses 140 in an outer liner 142 attached internally to a helmet outer shell 144. The one or more recess 140 can be configured to allow for controlled lateral or rotational displacement of the inner liner 138 such that, once the inner liner 138 moves a predetermined distance relative to the outer liner 142, as indicated by the arrow in FIG. 5, the lug 136 will abut or engage one or more of the walls of the corresponding recess 140, thereby stopping movement of the inner liner 138 relative to the outer liner 142 in that direction. The amount of rotation between the liners can also be controlled without the use of interlocking lugs 136, for example, by configuring the gap between the two liners to be other than spherical, e.g., by conforming it to an oblong shape like that of the wearer's head. This non-spherical shape will geometrically bind during rotation due to the contact of impingement points within the structure and thereby limit rotation.

In other embodiments, a similar system of lugs 136 and isolation dampers 130 can be implemented using only two layers or liners 138, 142, or alternatively, using three or more liners. It will be readily understood by those of skill in the art that a wide range of different configurations can be devised for the lugs 136 and isolation dampers 130 described herein. Indeed, the lugs 136 and isolation dampers 130 can take on a wide range of shapes, sizes, materials, and specific physical properties. They can also be configured to engage different layers differently than as illustrated and described herein.

In some embodiments, the isolation dampers 130 can be configured with specific physical properties that enable them to couple an inner liner 138 with an outer layer 142 and maintain a predetermined gap therebetween, or otherwise control the spatial relationship between the two liners 138, 142. Where a space is maintained between different layers, the space can comprise an air gap, or can be completely or partially filled with any suitable material in any form, including without limitation, a liquid, gel, foam, or gas cushion.

As illustrated in, e.g., FIG. 3, in some embodiments, the isolation dampers 108 can comprise elongated cylindrical features having opposite ends that can be fitted into corresponding recesses or passages in the inner and outer liners 104, 102. The isolation dampers 108 can be made of, for example, rubber, EPU foam, or any other suitable materials that have the specific design characteristics desired in a particular application. The isolation dampers 108 can be held in place by a friction fit or a wide range of adhesives, or alternatively, other methods of attachment can be used, depending on the specific application at hand. The isolation dampers 10 enable the inner, outer and one or more intermediate layers, if any, to move omnidirectionally relative to one another, including an inner liner 104 that is in a snug, direct contact with a wearer's head most commonly via a comfort liner.

As described above, in some embodiments, the isolation dampers 108 are configured so as to return the inner and outer liners 104 and 102 back to their respective initial or "neutral" resting positions relative to each other, once the rotational or translational force of an impact is removed from them. Thus, the outer shell 144 and internal liners of a helmet incorporating such an arrangement will quickly and automatically re-align themselves relative to each other after an impact. In this regard, it should be understood that the dimensions, shape, positioning, alignment, and materials of the isolation dampers 130 can be varied widely to tune the helmet to the specific application at hand.

Figure 7:
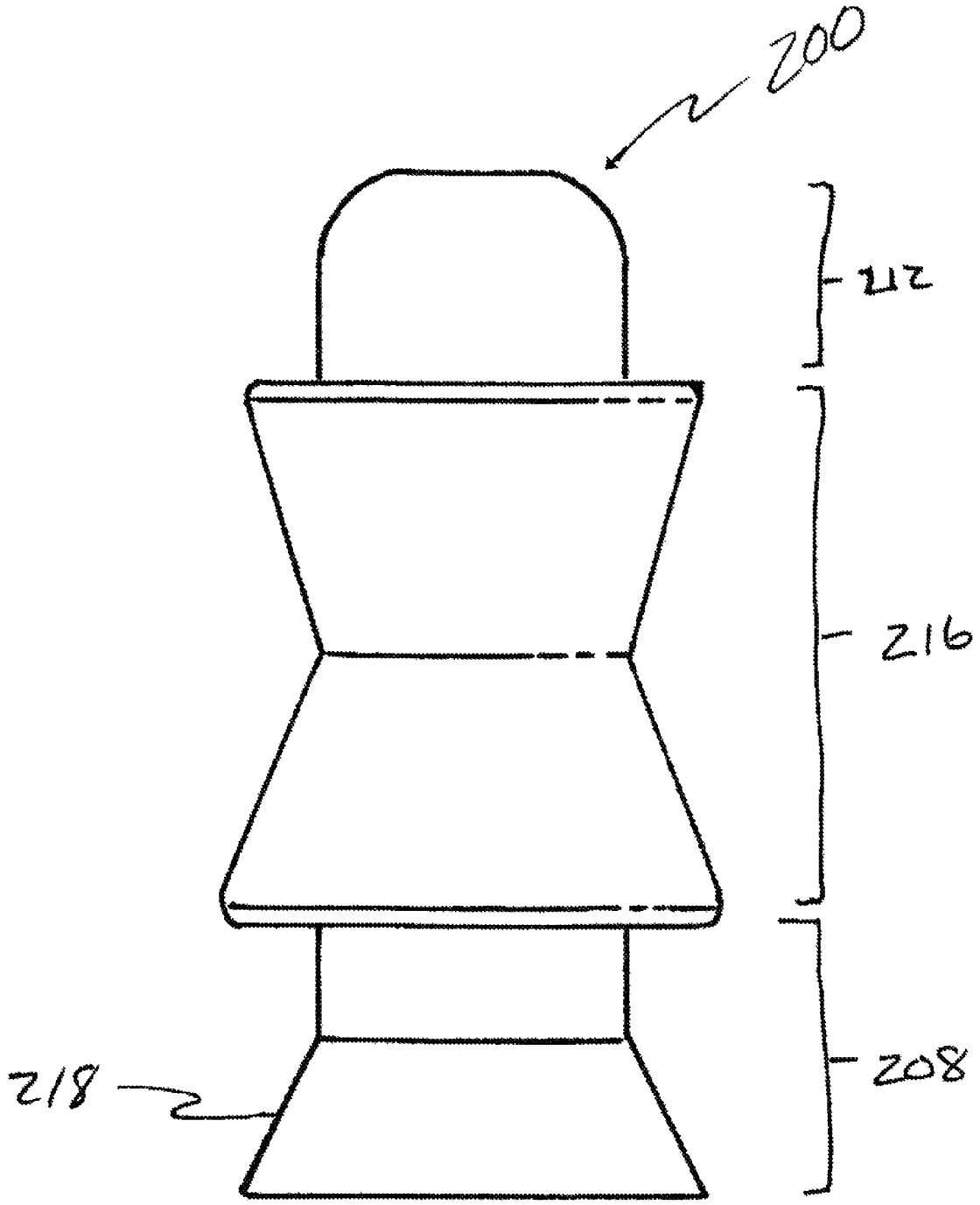
FIG. 7 is a side elevation view of an example of an isolation damper in accordance with the present invention, in accordance with an embodiment.
Figure 8:
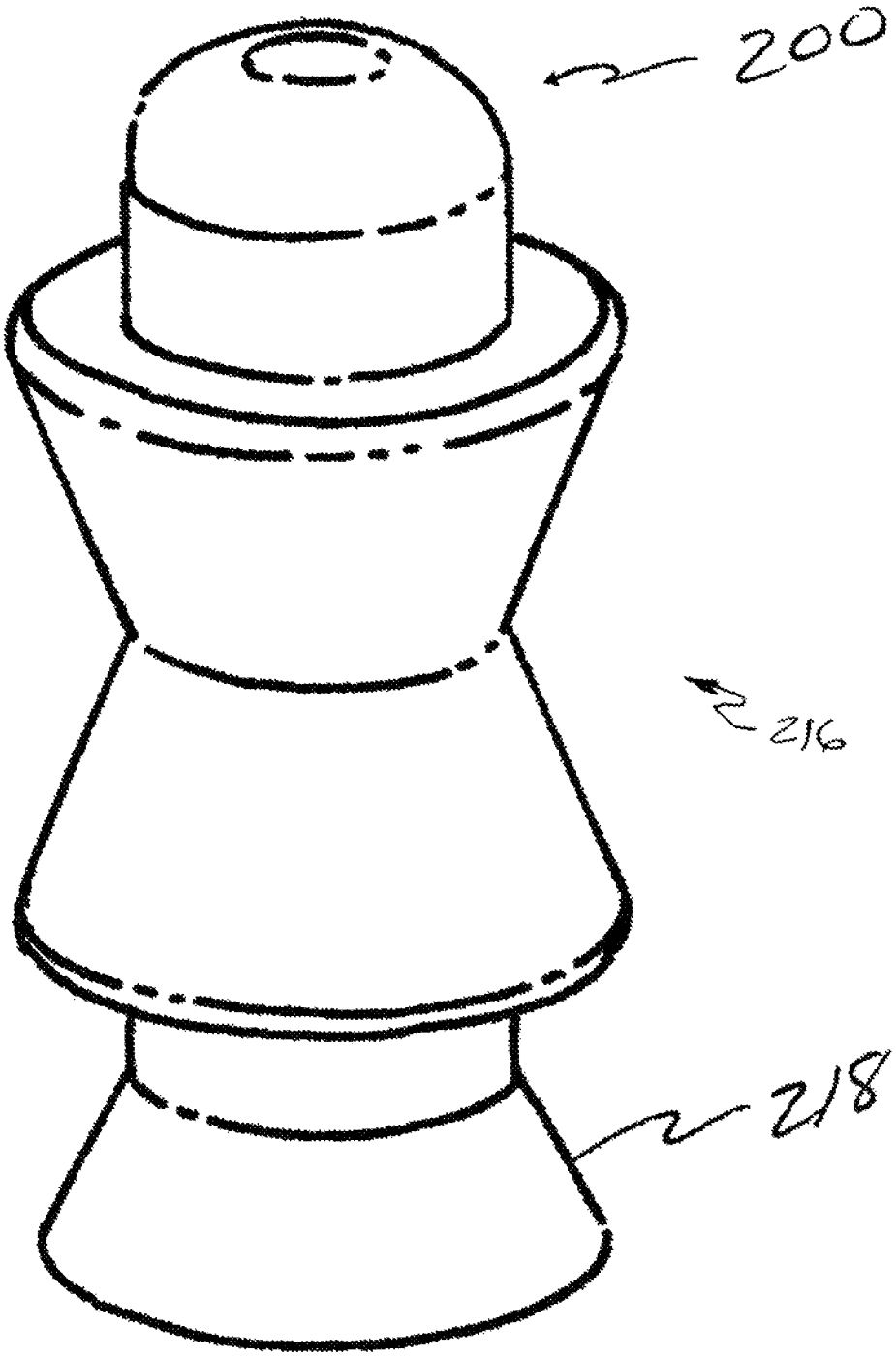
FIG. 8 is a side and top end perspective view of the isolation damper of FIG. 7 in accordance with an embodiment.
Figure 9:
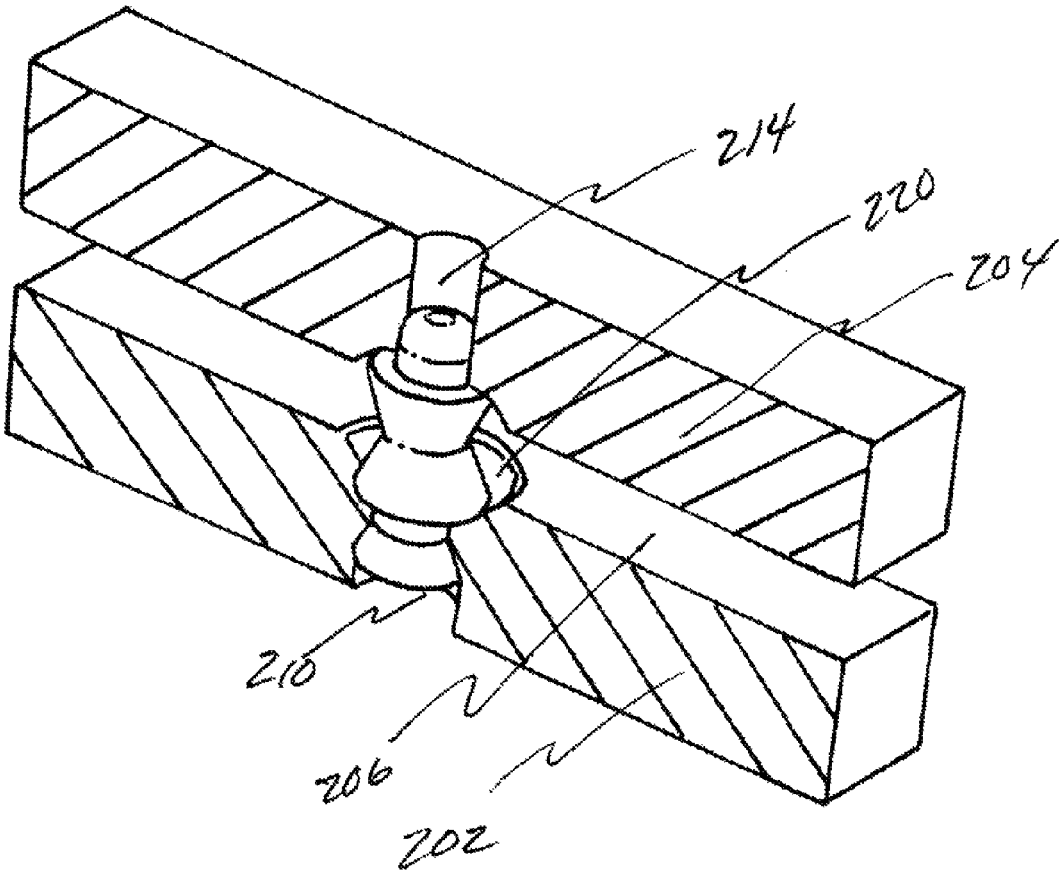
FIG. 9 is a partial cross-sectional view showing the isolation damper of FIG. 7 coupled between an inner and an outer liner of a helmet in accordance with an embodiment.

An example embodiment of an isolation damper 200 and its positioning with respect to an inner liner 202 and outer liner 204 disposed within a helmet assembly is illustrated in FIGS. 7-9. As illustrated in FIG. 9, the isolation dampers 200 can be configured to maintain a gap 206 between the inner and outer liners 202 and 204. The lower or inner end portion 208 of the isolation damper 200 can be inserted into a recess or aperture 210 having a complementary shape in the inner liner 202, and the upper or outer end portion 212 of the isolation damper 200 can be inserted into a complementary recess or aperture 214 in the outer liner 204. The middle section 216 of the isolation damper 200 will then be positioned between the inner and outer liners 202 and 204 and can serve to maintain the gap 206 between them.

As illustrated in FIGS. 7 and 8, in some embodiments, the lower end portion 208 of the example isolation damper 200 is configured with a frusto-conical shape 218 to help ensure that it is securely coupled to the inner liner 202. The middle section 216 of the isolation damper 200 can be configured in the shape of, for example, an hourglass, to provide specific flex, return, and force dispersion characteristics. In particular, such an hourglass shape can enhance the ability of the isolation damper 200 to absorb much of the energy of light-to-moderate impacts without damaging the inner and outer liners 202 and 204, and as discussed above, to return the liners 202, 204 to their original relative positions afterward.

In some embodiments, the apertures or recesses 210, 214 in the corresponding inner and outer liners 202 and 204 used to respectively retain the opposite ends 208 and 212 of the isolation dampers 200 can include specific geometries to manage the interaction between the isolation dampers 200 and the liners 202 and 204. For example, as illustrated in FIG. 9, in one embodiment, opposing frusto-conical recesses 220 can be disposed in the opposing surfaces of the liners 202 and 204 to allow the isolation damper 200 to move with a greater range of movement and to improve its stability. Specifically, the opposing frusto-conical recesses 220 provide a space for the isolation damper 200 to occupy during a deformation caused by, for example, a shearing type of impact. The respective geometries of the recesses 220 thus help to control the deformation, manage the spring rate, and constrain the shape of the corresponding isolation damper 200.

As those of some skill will understand, the specific shape and material properties of an isolation damper 200 are the primary control elements that affect its spring rate. As the geometry and/or material specifications of the isolation damper 200 are changed, the associated spring rate will change accordingly, following basic physical property relationships. For example, if only the length is increased, the spring rate will decrease, and the isolation damper 200 will become less resistant, in force per displacement, over a particular range of values. Further, if the geometric shape of the isolation damper is changed from one shape to another, for example, from a cylinder to an hourglass shape, the spring rate of the isolation damper 200 in axial compression versus its spring rate in a direction orthogonal to the direction of the axial compression can be altered and significantly changed to effect the desired performance requirements.

In addition to the physical shape of the isolation damper 200 and its material properties, the method by which the isolation damper 200 is constrained and allowed to deform, or prevented from deforming, is another design technique that can be used to control the dynamic interactions of an impact force acting on a helmet and how it is transferred from one liner to another liner. The opposing frusto-conical recesses 220 in opposing faces of the liners 202 and/or 204 described above are only one technique by which the dynamic movement characteristics of the isolation dampers 200 can be managed to control and modify the ability of the outer liner 204 to move in a desired fashion in both compression and shear directions relative to the inner layer 202.

If the volume of the isolation damper 200 cannot be reduced to zero, it must be displaced into another volume when it is compressed. If the spring rate of the isolation damper 200 is a function of its material properties and its ratio of compressibility into itself, then its spring rate will be nonlinear and will increase at an increasing rate. This increasing spring rate will grow as the isolation damper 200 is compressed and deformed, until it can no longer deform freely, at which time, the spring rate of the isolation damper 200 will increase rapidly such that it becomes virtually incompressible and exhibits an almost infinite resistance thereto. The frusto-conical recesses 200 in each liner 202, 204 at the respective attachment points of the isolation dampers 200 can be used to optimize these desired functions of movement in linear compression, shear movement and the point of contact of one liner with another liner by their geometric relationships to those of the associated isolation dampers 200, and also reducing the damage to the outer and inner liners that would be imposed onto them by the dampers as an additional control element.

Figure 10:
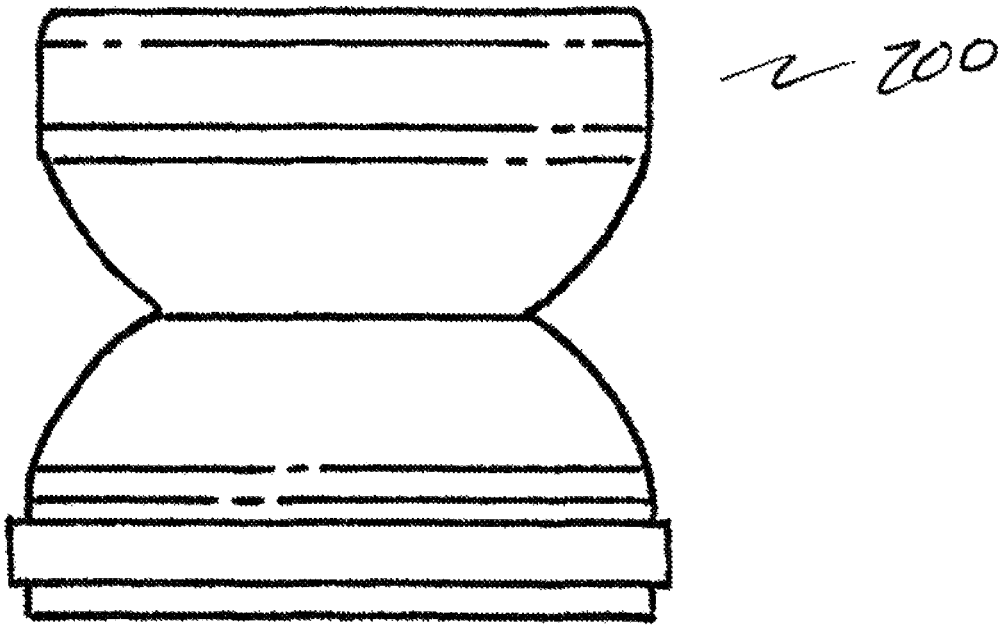
FIG. 10 is a side elevation view of another example of an isolation damper in accordance with an embodiment of the present invention.
Figure 11:
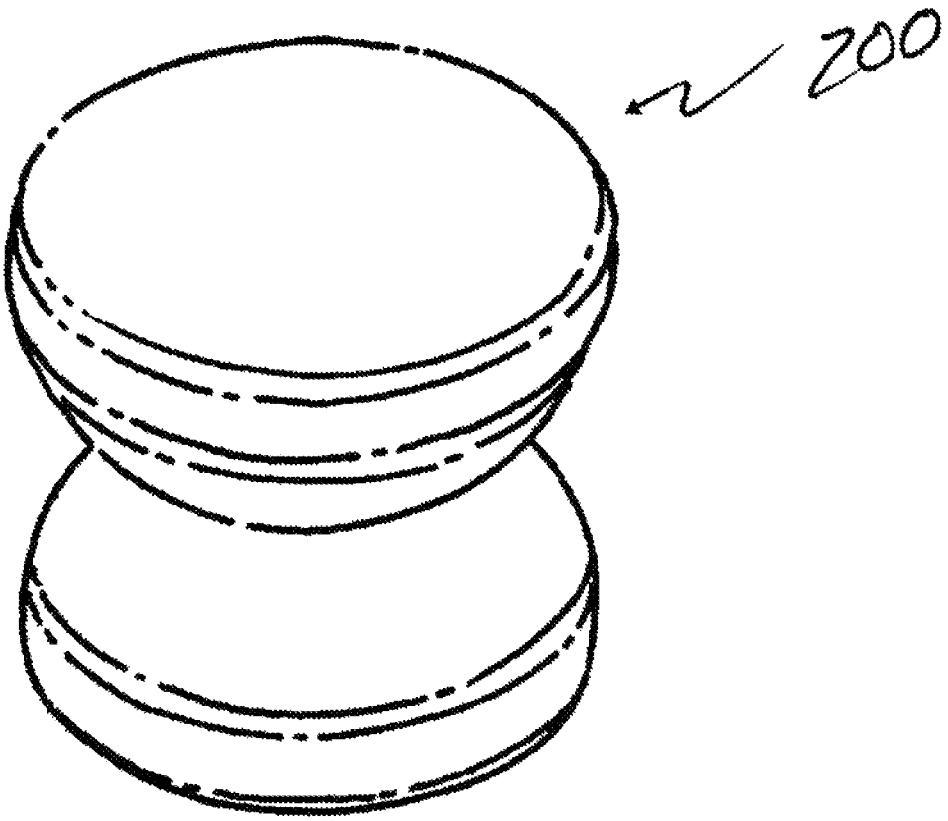
FIG. 11 is a side and top end perspective view of the isolation damper of FIG. 10 in accordance with an embodiment.
Figure 12:
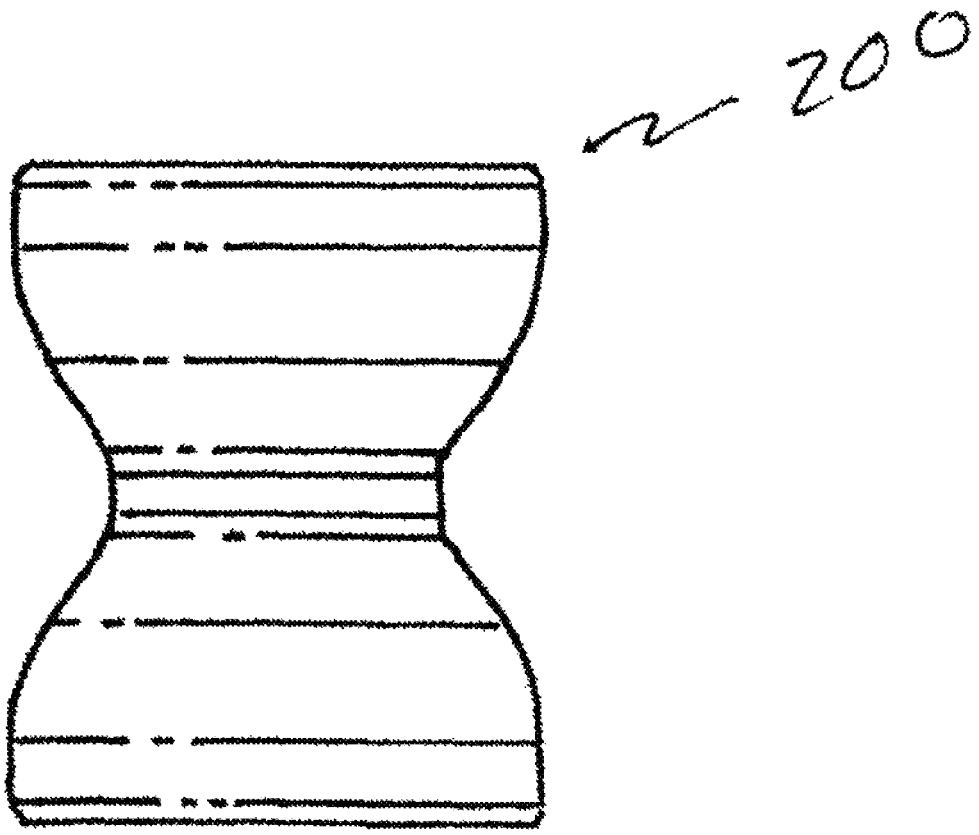
FIG. 12 is an elevation view of another example of an isolation damper in accordance with an embodiment.

The specific configurations, spacing, and quantity of the isolation dampers 200 can also be modified to obtain particular helmet impact absorbing characteristics suitable for the specific application at hand. Another example embodiment of an isolation damper 200 that is configured with more rounded contours is illustrated in FIGS. 10 and 11, and FIG. 12 illustrates yet another example isolation damper 200 with a slightly different geometry.

Figure 13:
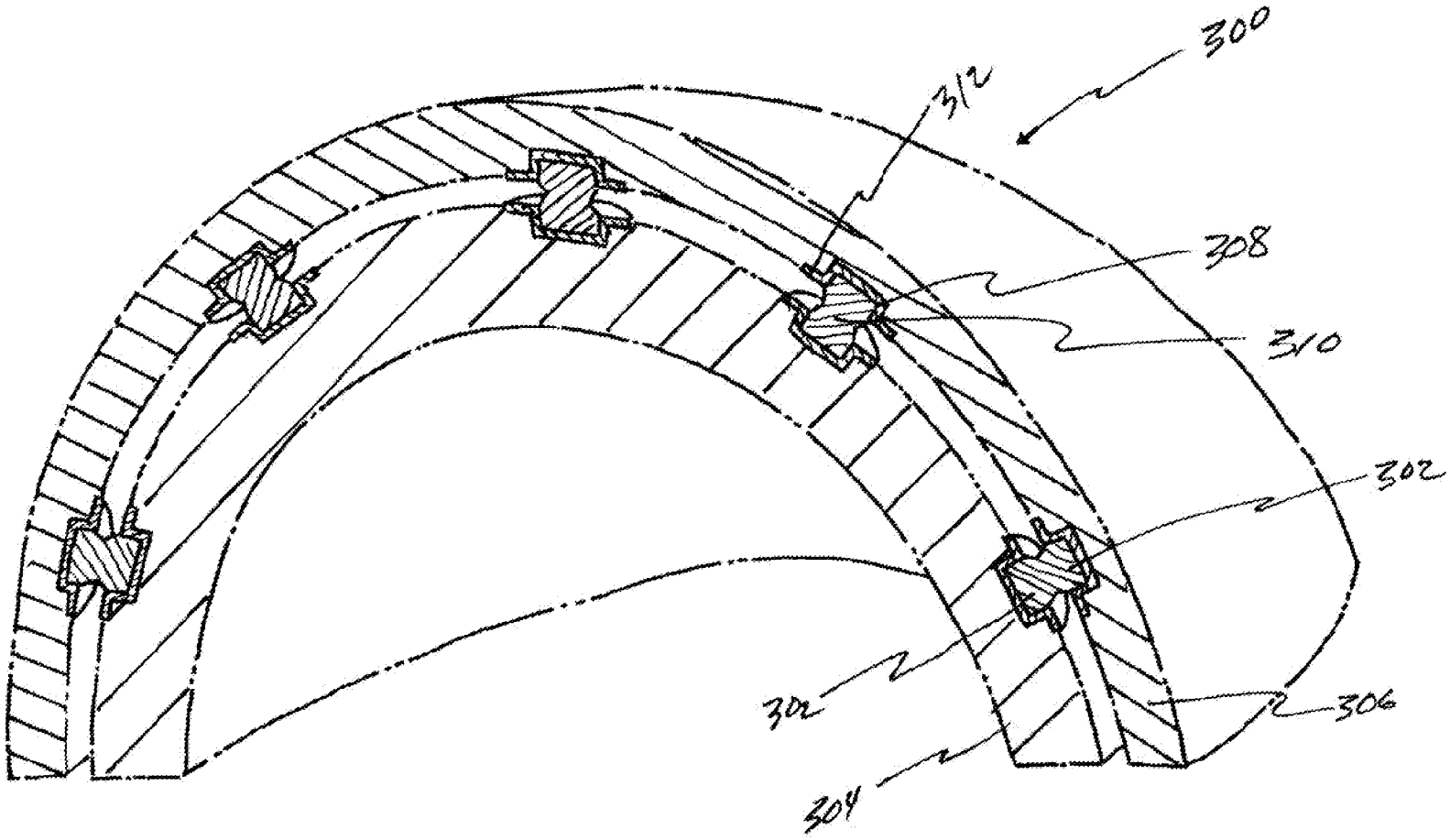
FIG. 13 is a partial cross-sectional view through another example helmet with inner and an outer liners, showing inserts respectively disposed in the liners and isolation dampers retained in the inserts, in accordance with an embodiment.

FIG. 13 is a partial cross-sectional view through an inner and an outer liner 304 and 306 of another example helmet 300. As discussed above in connection with the example helmet embodiment of FIG. 3 above and illustrated in FIG. 13, in some embodiments, the recesses or apertures in the inner and outer liners 304 and 306 of the helmet 300 within which the opposite ends of the isolation dampers 310 are respectively received can be respectively fitted with inserts or cup-like inserts 308 that locate and retain the isolation dampers 310 in place, provide additional support for the isolation dampers 310 within the liners 304, 306, and help to manage and disburse impact forces acting on the helmet 300. The inserts 308 can be configured with any suitable geometry and can include flanges 312 of appropriate sizes and/or shapes to distribute forces over a larger area of a corresponding one of the liners 304, 306.

Figure 14:
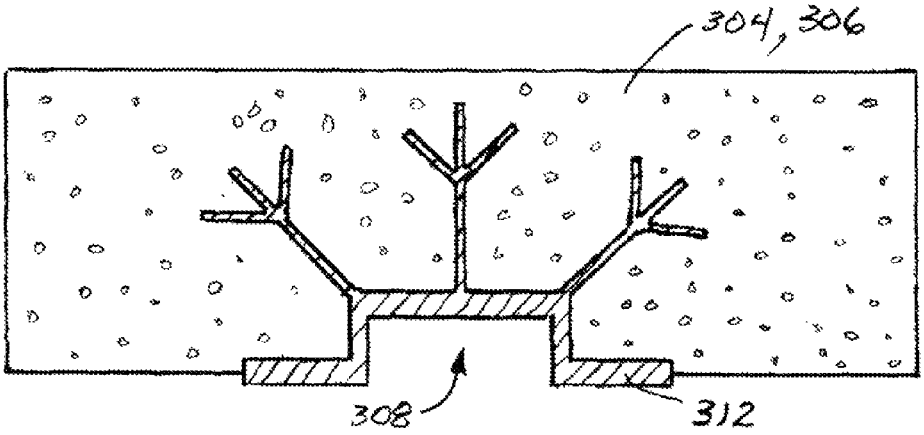
FIG. 14 is a partial cross-sectional view of a helmet liner, showing another example of an insert for retaining an end of an isolation damper molded therein, in accordance with an embodiment.
Figure 15A:
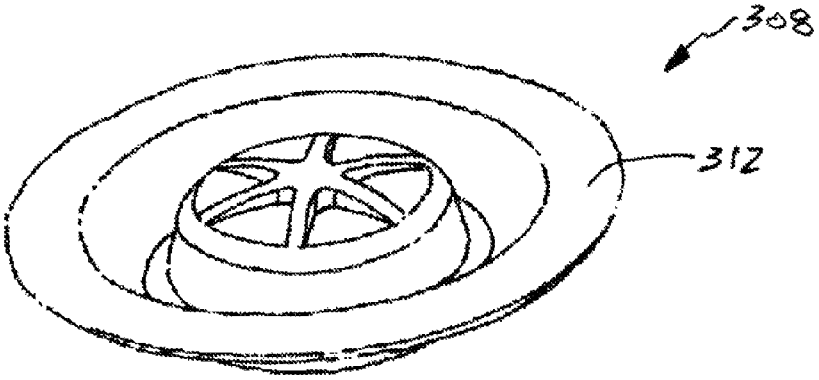
FIG. 15A is atop and side perspective view of another example of an isolation damper end retaining insert, in accordance with an embodiment.
Figure 15B:
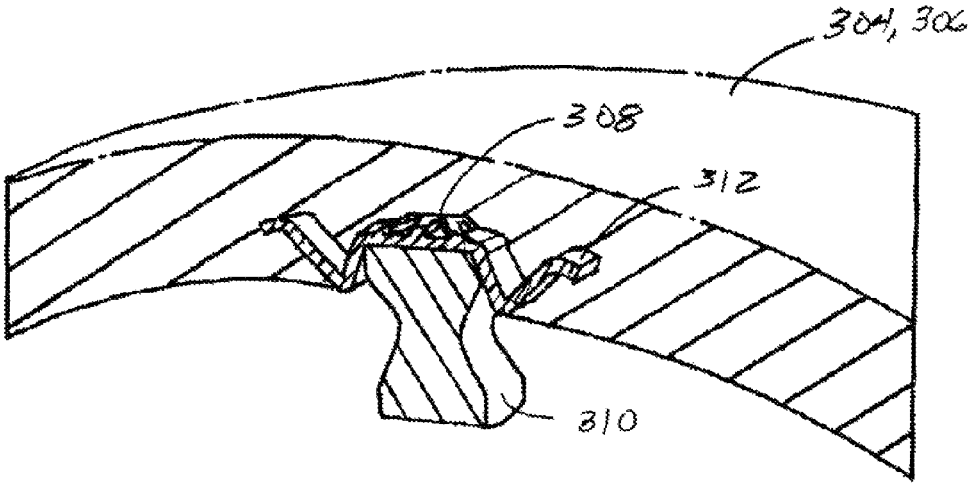
FIG. 15B is a partial cross-sectional view of a helmet liner having the insert of FIG. 15A molded therein, in accordance with an embodiment.

As illustrated in FIG. 14, in some embodiments, the inserts 308 respectively disposed on the inner and/or outer liners 304 and/or 306 can be over-molded into the associated liner 304 or 306 for attachment purposes, and as illustrated in the example embodiment of FIGS. 15A and 15B, can utilize the circumferential flange 312 in various sizes and configurations to help retain and distribute forces within the material of the associated liner 304 or 306.

The inserts 308 can be held in the associated liner 304 or 306 by, for example, friction, or alternatively, by any other suitable means, including adhesives, heat bonding and/or welding, and similarly, the respective ends of the isolation dampers 310 can held in the corresponding inserts 308 by friction, or alternatively, be fixed in the inserts 308 by any suitable method or means. The inserts 308 can be made of any suitable material, including thermosetting or thermoforming plastics, such as acrylonitrile butadiene styrene (ABS), polyvinylchloride (PVC), polyurethane (PU), polycarbonates, nylon, various alloys of metals, and the like.

Similarly, the isolation dampers 200 can be formed of a wide variety of elastomeric materials, including MCU (micro-cellular urethane), EPU, natural rubber, synthetic rubbers, foamed elastomers of various chemical constituents, solid cast elastomers of various chemical constituents, encased liquids, gels or gasses providing flexible structures, and any flexible assembly of any other kind that will provide the desired degree of omnidirectional movement.

The specific thicknesses of the various liners and gaps, if any, between them can be varied widely depending on the particular application of the helmet. The geometries and relative arrangement of the various liners and any gaps between them can also be varied to manage the characteristics of the helmet in response to impacts from a range of different directions and magnitudes. For example, in one specific example embodiment, inner and outer EPS liners with respective thicknesses of about twenty (20) millimeters and twelve (12) millimeters can be used with an air gap of about six (6) millimeter between them.

Figure 16:
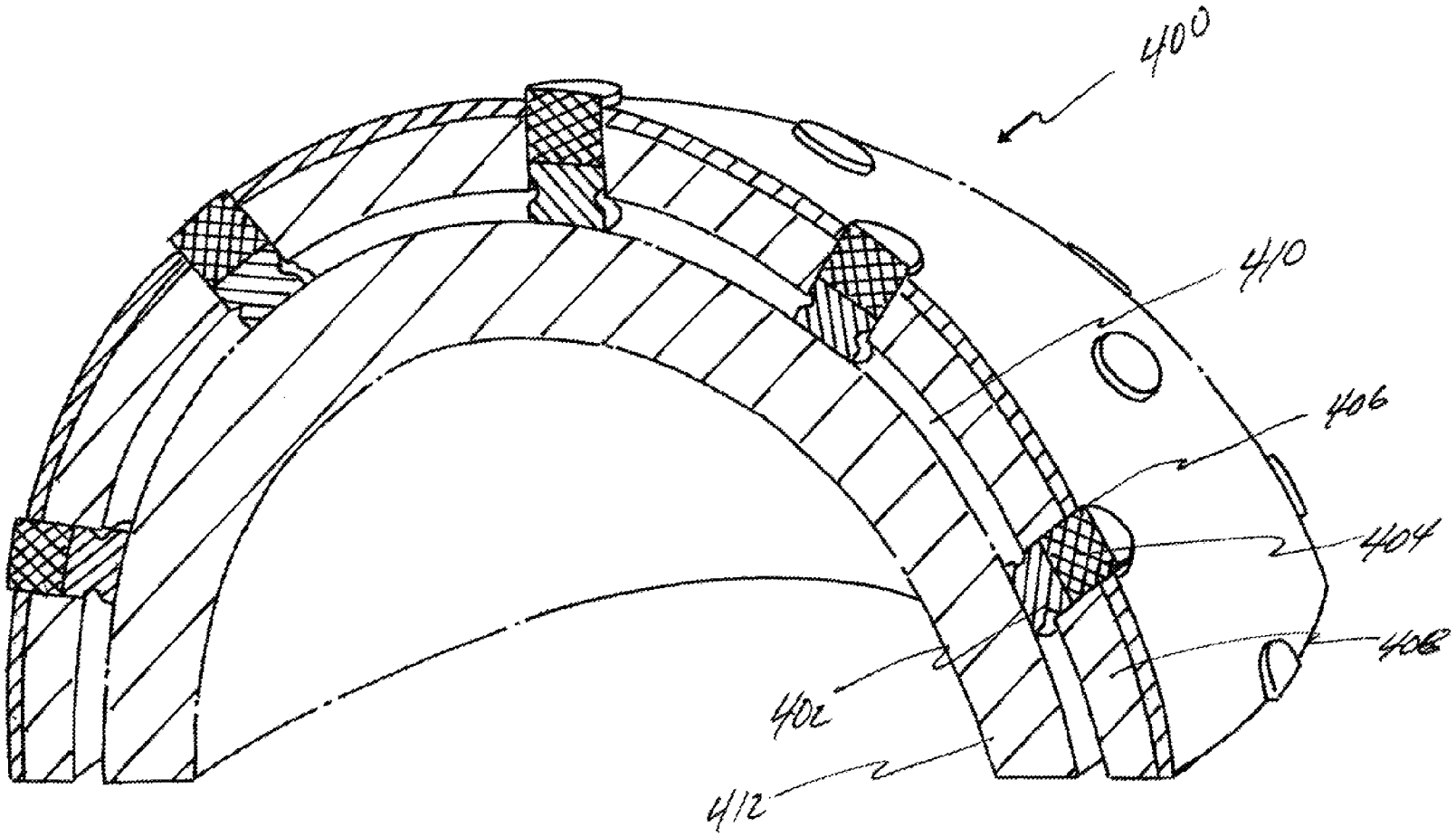
FIG. 16 is a partial cross-sectional view through another example helmet with inner and outer liners, showing isolation dampers coupled between the liners and fittings extending through recesses in the outer liner and respectively coupled to the isolation dampers, in accordance with an embodiment.

FIG. 16 is a cross-sectional view of another example embodiment of a helmet 400 in which isolation dampers 402 are affixed, e.g., with an adhesive, to an outer surface of an inner liner 412, and associated plugs 404 extending through corresponding recesses 406 disposed in the outer liner 408 to fill the recesses to establish a desired "pre-load" on the isolation dampers 402. The isolation dampers 402 are selectively distributed across the geometry of the helmet 400. As discussed above, the isolation dampers 402 can maintain a selected spacing or gap 410 between the inner liner 412 and outer liner 408. Also, it should be understood that, as in the embodiments above, the isolation dampers 402 can be distributed in any arrangement desired to tune the particular energy management characteristics of the helmet 400. The arrangement of the isolation dampers 402 can be regular or irregular, and can allow for a complete separation or a partial contact between different liners.

Figure 17:
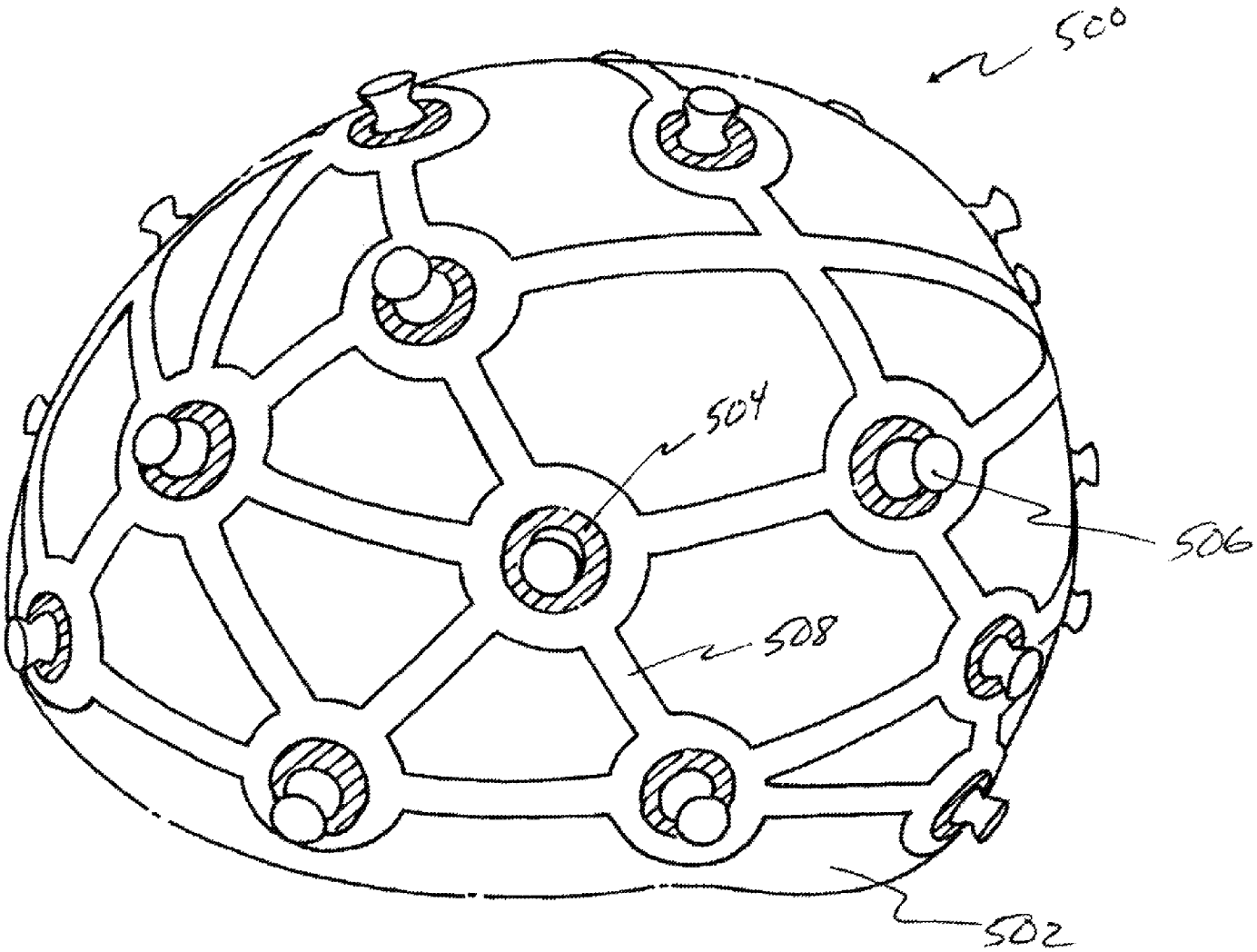
FIG. 17 is a top and left side perspective view of an example of an inner liner fitted with inserts, showing isolation dampers respectively fitted into the inserts and reinforcing strands interconnecting the inserts, in accordance with an embodiment.

FIG. 17 is a top and left side perspective view of an example inner liner 502 of a helmet 500 embodiment having an outer surface that is fitted with inserts 504, showing isolation dampers 506 respectively fitted into the inserts 504 and reinforcing webs or strands 508 interconnecting some or all of the inserts 504 so as to form a web-like structure that distributes forces across the surface of the liner 502. As described above, the isolation dampers 506 can be fitted into the inserts 504 and held therein by, e.g., a friction fit and/or with adhesives. The interconnecting strands 508 can be formed using any suitable material, and can be formed on either or both of the inner and/or the outer surface of the liner 502 by, for example, an overmolding process in which the interconnecting strand structure 508 is molded onto the surface of the EPS liner. Alternatively, the inserts 504 and interconnecting strands 508 can be combined in an integral molded, e.g., injection molded, assembly and then bonded to the associated liner.

As those of some skill will understand, interconnecting some or all of the inserts 504 can be used to manage the load distribution from the isolation dampers 506 across the liner 502. Of course, the same technique can be used in an outer liner and/or an intermediate layer (not illustrated) to good effect. Interconnections 508 with various geometries can be provided among a group of inserts 504 to increase the respective load distribution areas of the liners and/or layers. Interconnection of the inserts 504 can also add significant tensile strength to the liner or layer as a whole. Interconnections 508 can also help to separate the elastic deformation and spring rate of the isolation dampers 506 from those of the associated liner or layer itself, providing for a greater control over the response of the helmet 500 to different types of impact forces.

For example, when used with an EPS liner 502, an interconnected web structure 508 can decrease the force per unit area of the shear and compressive forces respectively exerted by the isolation dampers 508 on the liner 502. This creates a larger, less sensitive range of elastomer compression by reducing the elastic deformation of the EPS foam material of the liner 502 and minimizing failure of the EPS air cells that can, dependent on the EPS foam density rating, rupture under certain impact force levels. Since the rupturing of air cells in EPS is inimical to its impact absorbing performance, the inserts 504 and interconnections 508 can eliminate or substantially reduce the damage resulting from small and medium force impacts and preserve the ability of the EPS to absorb the forces of larger impacts.

The ability to control and separate the spring rates of the different components using inserts 504 and interconnections 508 increases the ability to tune the protective characteristics of the helmet 500 and provide superior protective qualities. For example, the isolation dampers 506 can be configured using different materials and geometries not only to allow for rotational deformation, but also to increase their effective spring rate at the point of contact between one EPS liner and another so as to prevent a hard impact or rapid acceleration between the two liners.

Figure 18:
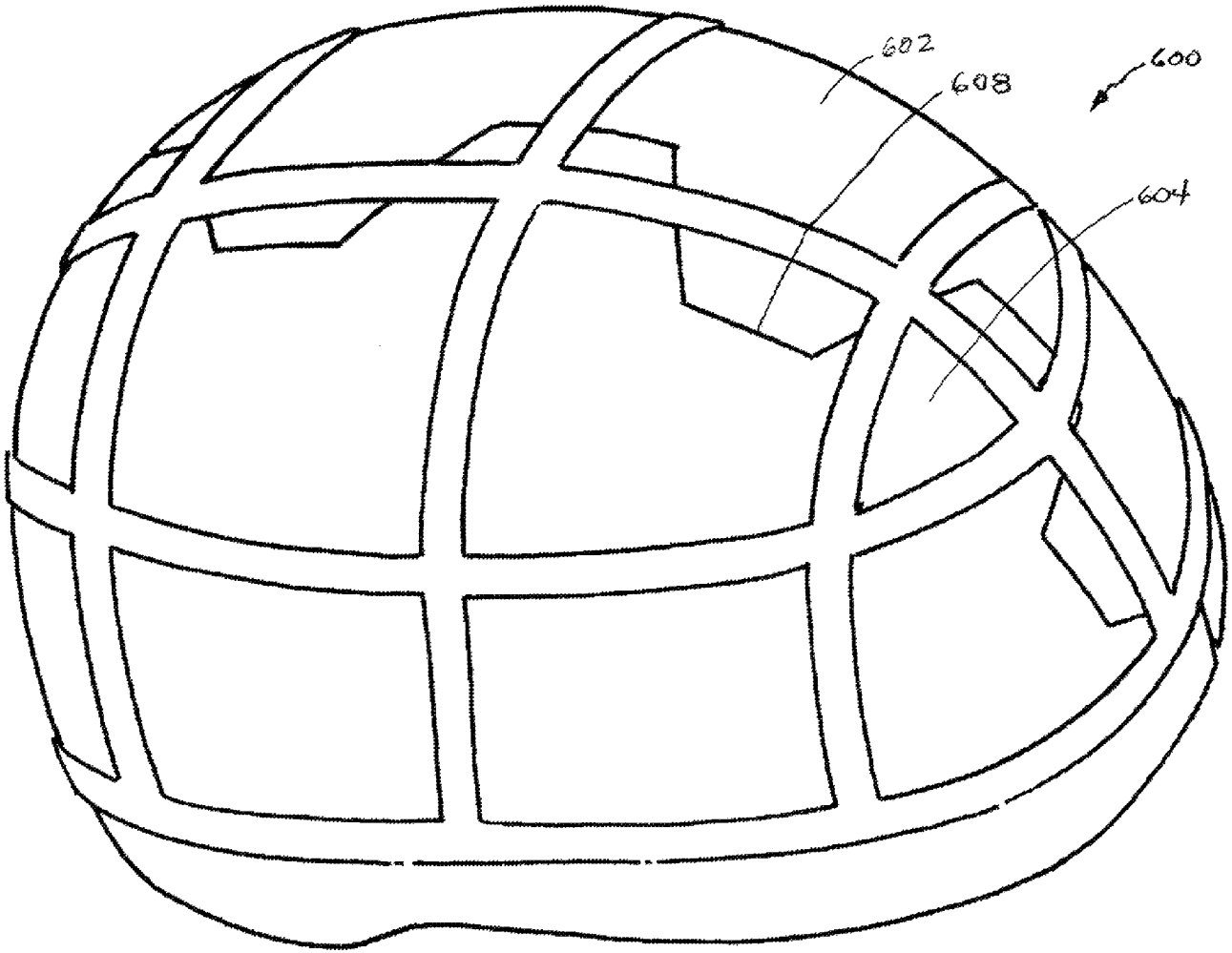
FIG. 18 is a top and right side perspective view of a helmet outer liner assembly in accordance with an embodiment; and, FIG. 19 is a partial perspective view of a helmet inner and outer liner, showing another example of isolation dampers, in accordance with an embodiment.

An embodiment of a helmet outer liner assembly 600 in accordance with the present disclosure is illustrated in the perspective view of FIG. 18. In the embodiment of FIG. 18, the outer liner assembly 600 comprises two liner halves 602 and 604 of a full liner that is split about the centerline from the forehead to the back in a zigzag pattern 606 and assembled together by various bonding agents or mechanical means, and then reinforced by the addition of an exoskeleton structure 608 designed to retain the assembly and add strength to resist the force of an impact to a helmet within which the liner 600 is disposed. The splitting of the outer liner 600 is to provide a manufacturing method of assembly of the outer liner 600 to an inner liner (not illustrated) with the isolation dampers (not illustrated) installed as an alternative method to inserting the inner liner into the outer liner 600 and the attachment of the dampers to both liners during these two processes. The split liner 600 provides the added option to allow for over molding of recess cups into the EPS, or other foam liner materials, to increase the strength of the system and smooth out the manufacturing processes.

Figure 19:
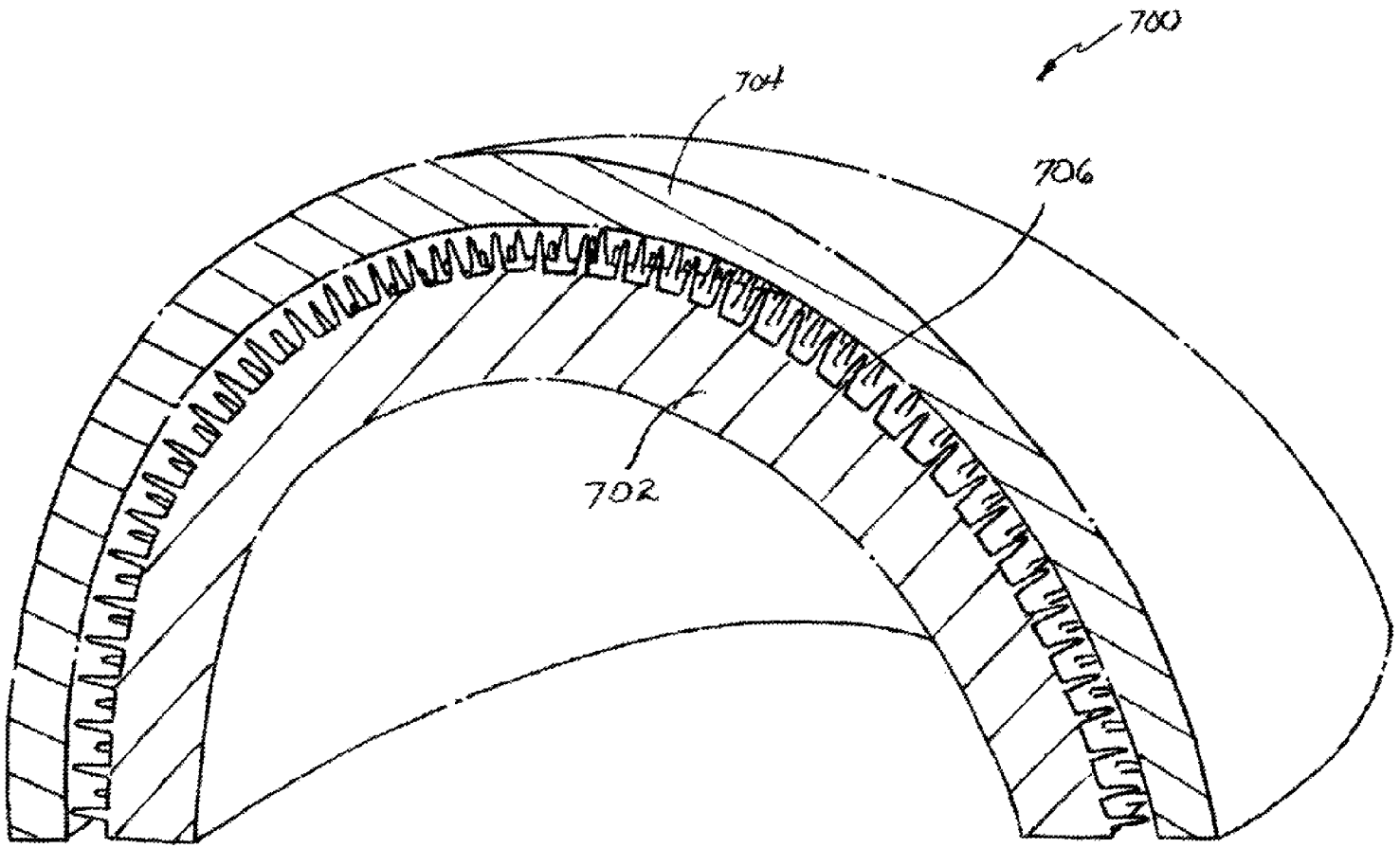

FIG. 19 illustrates an embodiment of a helmet liner assembly 700 in which the outer and inner liners 702 and 704 are spaced by an optional isolation damping method, which is retained by various bonding agents or mechanical means. This embodiment consists of the outer and inner liners 702 and 704 spaced by a high density array of small diameters of flexible columns 706, like a hair brush or "porcupine," that are attached to both liners by mechanical means or bonding, that displace under impact in any direction providing omnidirectional movement in linear impact and shearing forces. The elastomeric "porcupine" material 706 can be made as individual components or as a molded assembly and applied in various array patterns between the two liners 702, 704 or designed to be over molded into the liner materials as an alternative method. As small cylindrical shaped columns 706, this embodiment will compress and buckle under an impact load as well as provide movement in rotational shear as the columns bend and compress under load. The negative of this method is that there is a lot of material in the dampers 706 that will be compressed onto its self as it has no specific volume to retreat into as it compresses as in previous embodiments described, to get a good result it may take a much larger gap between the two liners to achieve desired performance.

Initial laboratory testing of prototype helmets using the omnidirectional impact energy management systems of the invention indicates that it is highly effective in managing both translational and rotational impact forces. Testing indicated that the prototype helmets exceed DOT, ECE, and Snell test standards, while providing significantly better overall protection against the likelihood of brain injury, particularly in the range of lower threshold impact velocities less than about 120 G-force peak accelerations. It is commonly understood that concussion injuries commonly occur in the range of about 80 to about 100 G-force peak acceleration in adult males. The prototypes also performed significantly better in terms of time attenuation, that is, slowing down the transfer of energy during an impact. The chart below (Table 1) compares the best performing prototype helmet test to date ("Proto 6") against a control helmet of the same model having a conventional liner for peak acceleration (measured in g-force) and Head Impact Criteria ("HIC") values, including the percentage increase up or down.

TABLE 1

| Dro Test | Control Helmet | Prototype Helmet | % +/− |
|---|---|---|---|
| Peak Acc. G's #1 | 46.5 | 31.6 | −32.0% |
| Peak Acc. G's #2 | 121.2 | 104.9 | −13.4% |
| Peak Acc. G's #3 | 209.9 | 179.2 | −14.6% |
| HIC #1 | 57 | 30 | −47.4% |
| HIC #2 | 516 | 348 | −32.6% |
| HIC #3 | 1545 | 1230 | −20.4% |

By using different materials and configurations, it is possible to adjust or tune the protection provided by helmets that use the systems of the disclosure, as would be understood by one skilled in the art. The liners and any other layers can be formed from materials with distinct flexibility, compression, and crush characteristics, and the isolation dampers can be formed from various types of elastomers or other appropriate energy absorbing materials, such as MCU. Thus, by controlling the density and stiffness of the isolation dampers and related internal constructional materials, safety helmets can be configured to strategically manage impact energy based on the known range of common head weights expected to be present in any given helmet, and by helmet size, and by any give sporting activity.

The foregoing description is presented so as to enable any person skilled in the art to make and use the invention. For purposes of explication, specific nomenclature has been set forth to provide a thorough understanding of the disclosure. However, it should be understood that the descriptions of specific embodiments or applications provided herein are provided only by way of some example embodiments of the invention and not by way of any limitations thereof. Indeed, various modifications to the embodiments will be readily apparent to those skilled in the art, and the general principles defined herein can be applied to other embodiments and applications without departing from the spirit and scope of the invention. Thus, the present invention should not be limited to the particular embodiments illustrated and described herein; but should be accorded the widest possible scope consistent with the principles and features disclosed herein.

What is claimed is:

1. A helmet, comprising:

an outer shell;

an outer liner directly coupled, on a first side facing away from a wearer when worn, to the outer shell and having at least one concave recess on an opposing second side;

an isolation disk comprising:

an outer side and an opposing inner side, at least one convex protrusion that is at least partially disposed within the at least one concave recess of the outer liner, and at least one concave recess on the opposing inner side; and an inner liner having at least one convex protrusion disposed at least partially within the at least one concave recess on the opposing inner side of the isolation disk.

2. The helmet of claim 1, wherein the isolation disk comprises a generally circular disk.

3. The helmet of claim 2, wherein the isolation disk further comprises a flange extending around a circumfery of the generally circular disk.

4. The helmet of claim 1, wherein the at least one convex protrusion of the isolation disk has a shape that is complementary to a shape of the at least one concave recess of the outer liner.

5. The helmet of claim 1, wherein the at least one concave recess of the isolation disk has a shape that is complementary to a shape of the at least one convex protrusion of the inner liner.

6. The helmet of claim 1, further comprising a mechanism for preventing at least one of over-rotation and/or over-translation of the inner liner relative to the outer liner.

7. The helmet of claim 6, wherein the mechanism comprises at least one flange extending from an outer surface of the inner liner and at least partially disposed in engagement with a corresponding recess in the outer liner.

8. A helmet, comprising:

an outer shell having an inner side configured to face a wearer's head;

an outer liner having a first side facing away from the wearer when worn and an opposing second side, wherein the outer liner is disposed within the inner side of the outer shell and directly coupled on the first side to the outer shell;

at least one isolation disk disposed between and coupled to the outer liner and an inner liner, wherein the inner liner is disposed within the inner side of the outer shell and coupled to the opposing second side of the outer liner by the at least one isolation disk;

at least one flange extending from an outer surface of the inner liner and disposed in engagement with a corresponding recess in the outer liner for preventing over-rotation, over-translation, or over-rotation and over-translation of the inner liner relative to the outer liner; and wherein the at least one isolation disk is resilient to provide omnidirectional movement of the inner liner relative to the outer liner and the outer shell and to return the inner liner toward an initial resting position relative to the outer liner and the outer shell after an external impact to the outer shell.

9. The helmet of claim 8, wherein the at least one flange is configured to allow for controlled lateral or rotational displacement of the inner liner such that, once the inner liner moves a predetermined distance relative to the outer liner, the flange will abut or engage one or more walls of the corresponding recess in the outer liner, thereby stopping movement of the inner liner relative to the outer liner.

10. The helmet of claim 8, wherein the inner liner comprises expanded polypropylene and wherein the outer liner comprises expanded polystyrene.

11. The helmet of claim 8, wherein the at least one isolation disk has a shape that is complementary to a shape of the recess of the outer liner.

12. The helmet of claim 11, wherein the at least one isolation disk has a shape that is complementary to a shape of at least one convex protrusion of the inner liner.

* * * * *